US008431814B2

(12) United States Patent
Wessels

(10) Patent No.: US 8,431,814 B2
(45) Date of Patent: Apr. 30, 2013

(54) LASER PICK-UP FOR A STRINGED MUSICAL INSTRUMENT

(76) Inventor: Mark A. Wessels, Lewisville, TX (US)

( * ) Notice: Subject to any disclaimer, the term of this patent is extended or adjusted under 35 U.S.C. 154(b) by 449 days.

(21) Appl. No.: 12/174,980

(22) Filed: Jul. 17, 2008

(65) Prior Publication Data

US 2010/0011942 A1 Jan. 21, 2010

(51) Int. Cl.
*G10H 3/06* (2006.01)

(52) U.S. Cl.
USPC ..... 84/724

(58) Field of Classification Search ..... 84/724
See application file for complete search history.

(56) References Cited

U.S. PATENT DOCUMENTS 4,815,353 A * 3/1989 Christian ..... 84/724
5,012,086 A * 4/1991 Barnard ..... 250/222.1
5,446,751 A * 8/1995 Wake ..... 372/46.01

* cited by examiner

*Primary Examiner* — Jeffrey Donels
(74) *Attorney, Agent, or Firm* — Michael Diaz

(57) ABSTRACT

A laser pick-up apparatus and method for a stringed musical instrument. The laser pick-up includes a laser diode affixed to the musical instrument. The laser diode is capable of generating a laser beam. The laser pick-up also includes a photodetector affixed to the musical instrument adjacent the laser diode. The photodetector is capable of detecting light from the laser beam. The photodetector includes a conversion mechanism for converting the detected light into electrical signals. The laser diode is positioned on the musical instrument to direct the laser beam toward the string. The laser beam is reflected off the string and received by the photodetector. The photodetector then converts the detected light from the reflected laser beam into electrical signals which provide sound to an amplifier.

16 Claims, 5 Drawing Sheets

10

LASER PICK-UP FOR A STRINGED MUSICAL INSTRUMENT

BACKGROUND OF THE INVENTION

1. Field of the Invention

This invention relates to musical instruments. Specifically, and not by way of limitation, the present invention relates to a laser pick-up for use on a stringed musical instrument.

2. Description of the Related Art

There are a wide variety of stringed musical instruments. One very popular stringed instrument is an electric guitar. A conventional electric guitar is a type of guitar which utilizes pick-ups to convert the vibration of its steel-cored strings into an electrical current. The electric current is then amplified by an instrument amplifier and outputted as sound through a speaker. Oftentimes, the signals emanating from the guitar are electronically altered with guitar effects, such as reverb or distortion.

Electric guitars make comparatively little audible sound in comparison to an acoustic guitar because the strings of an electric guitar have their strings plucked. Instead, the movement of the strings generates or induces a very small electrical current in the magnetic pick-ups. The magnetic pick-ups are magnets which are wrapped with coils of very fine wire. The induced current is then sent via a wire to an amplifier. The induced current is dependent upon such factors as the density of the string or the amount of movement over the pick-ups. The vibration of the strings is, in turn, affect by several factors, such as the composition and shape of the body of the guitar.

There are also some hybrid electric-acoustic guitars which are equipped with additional piezoelectric pick-ups or transducers that sense mechanical vibrations from the body of the guitar. Because in some cases it is desirable to isolate the pick-ups from the vibrations of the strings, a guitar's magnetic pick-ups are sometimes embedded or "potted" in epoxy or wax to prevent the pick-up from having a "microphone" effect.

Because of their natural inductive qualities, magnetic pick-ups suffer from the disadvantage of picking up ambient and usually unwanted electromagnetic noises. The resulting noise, an unwanted "hum," is particularly strong with single-coil pick-ups, and aggravated by the fact that very few guitars are correctly shielded against electromagnetic interference. The most frequent cause of this hum is the strong 50 or 60 Hz component that is inherent in the frequency generation of current within the local power transmission systems. As nearly all amplifiers and audio equipment associated with electrical guitars relies on this power, there is, in theory, little chance of completely eliminating the introduction of unwanted hum.

Double-coil pick-ups, also known as "humbuckers," were invented as a way to reduce or counter the unwanted ambient hum sounds. Humbuckers have two coils of opposite magnetic and electric polarity. Thus, electromagnetic noise hits both coils, which should cancel itself out. The two coils are wired in phase, so the signal picked up by each coil is added together. This creates the richer, "fatter" tone associated with humbucking pick-ups. A pick-up is needed which is not susceptible to picking up unwanted ambient noises.

Thus, it would be advantageous to have a pick-up for use on stringed instruments which generates signals from vibrating strings of a musical instrument without picking up unwanted ambient noise. It is an object of the present invention to provide such an apparatus and method.

SUMMARY OF THE INVENTION

The present invention is a light pick-up apparatus and method for use on a stringed musical instrument. In one aspect, the present invention is directed to a light pick-up that includes a laser diode affixed to the musical instrument. The laser diode is capable of generating a laser beam. The laser pick-up also includes a photodetector affixed to the musical instrument adjacent the laser diode. The photodetector is capable of detecting light from the laser beam. The photodetector includes a conversion mechanism for converting the detected light into electrical signals. The laser diode is positioned on the musical instrument to direct the laser beam toward the string. The laser beam is reflected off the string and received by the photodetector. The photodetector then converts the detected light from the reflected laser beam into electrical signals which provide sound to an amplifier.

In another aspect, the present invention is directed to a light pick-up system for use on a musical instrument. The system includes a musical instrument having at least one string, a body, and an outer surface. The system also includes at least one light pick-up corresponding to the string. The light pick-up includes a light generation mechanism affixed to the musical instrument. The light generation mechanism generates a light beam. The light pick-up also includes a photodetector affixed to the musical instrument adjacent the light generation mechanism for detecting light from the light beam. The photodetector is capable of converting the detected light into electrical signals. The light generation mechanism is positioned on the musical instrument to direct the light beam toward the string. The light beam is reflected off the string and received by the photodetector. The photodetector converts the detected light from the reflected light beam into electrical signals.

In still another aspect, the present invention is directed to a method of utilizing a light pick-up having a light generation mechanism and a photodetector located on a musical instrument having at least one string. The method begins by the light generation mechanism emitting a light beam. The light beam is then reflected off the string of the musical instrument. Next, the photodetector detects the light from the reflected light beam and converts the detected light into electrical signals. The electrical signals are then converted into sound corresponding to the vibrations of the string.

DESCRIPTION OF THE INVENTION

Figure 1:
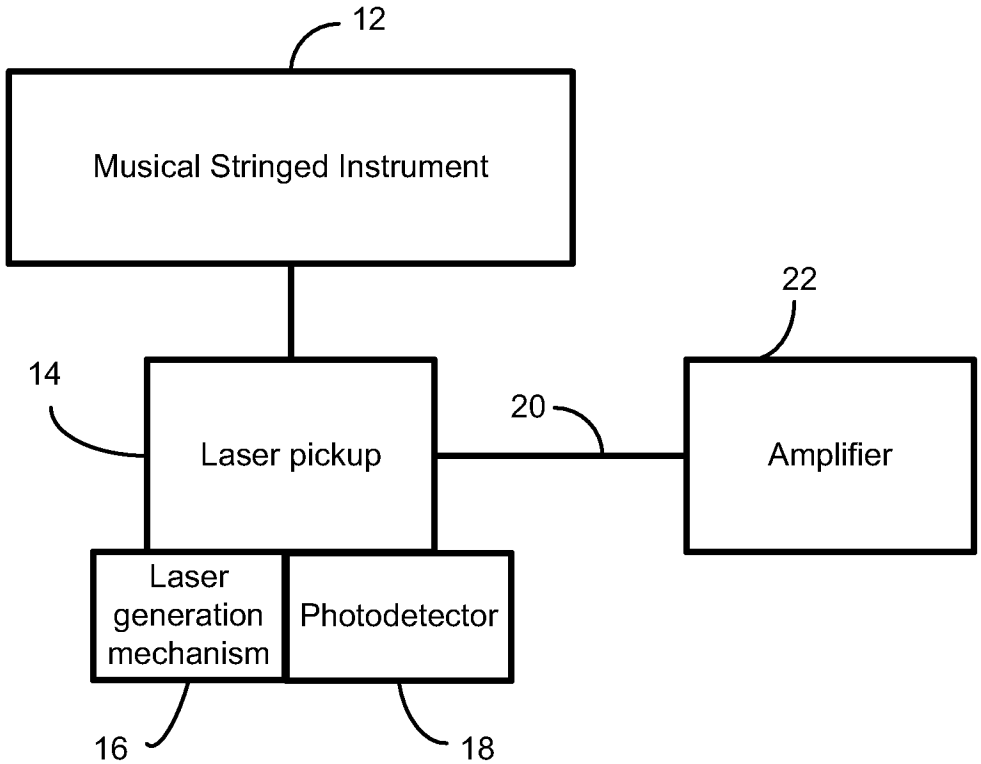
FIG. 1 is a simplified block diagram of the components of a laser pick-up system in the preferred embodiment of the present invention.

The present invention is a laser pick-up for a stringed instrument. FIG. 1 is a simplified block diagram of the components of a laser pick-up system 10 in the preferred embodiment of the present invention. The laser pick-up system 10 includes a musical stringed instrument 12, at least one laser pick-up 14 having a laser generation mechanism 16 and a photodetector 18, and a connection 20 leading from the laser pick-up 14 to an amplifier 22.

The musical stringed instrument 12 may be any musical instrument having strings, such as a guitar, a violin or a cello. The laser pick-up is attached to the body of the stringed instrument 12 near the strings of the stringed instrument 12.

Figure 2:
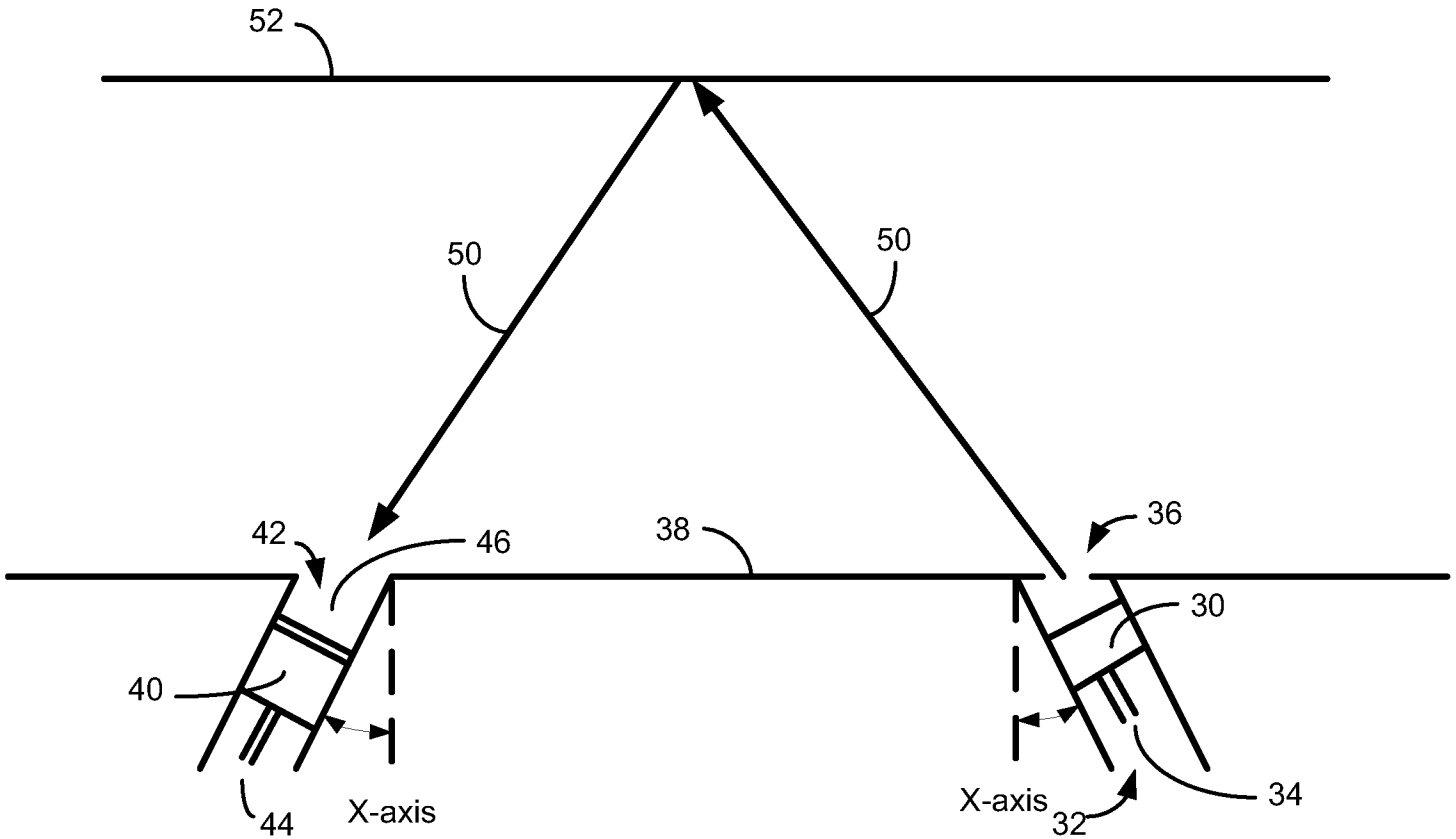
FIG. 2 is a side view of the laser pick-up in the preferred embodiment of the present invention.

FIG. 2 is a side view of the laser pick-up in the preferred embodiment of the present invention. The laser pick-up includes the laser generation mechanism 16. The laser generation mechanism includes a laser diode 30 mounted within a channel 32. The laser channel is coupled to an electrical pin or pins 34 providing power to the laser diode 30. The laser channel is positioned adjacent a laser aperture 36 located on a surface 38 of the musical stringed instrument 12. The laser diode is preferably canted at a 30 degree angle from an X-axis.

The laser pick-up also includes a photodetector 40 mounted in a channel 42. The photodetector 40 is coupled in an electrical pin or pins 44 providing power to the photodetector 40. An optical filter 46 is preferably located over the photodetector. The photodetector is position adjacent the surface 38. The photodetector 40 is preferably canted at an opposing 30 degree angle relative to the laser diode from the X-axis.

The laser diode is powered from a power source (not shown) coupled to the pins 34. The laser diode generates a laser beam 50, preferably invisible to the naked eye, which detects vibrations of a musical instrument string 52 located adjacent the laser generation mechanism 16. The laser beam 50 bounces off the string 52 and is detected by the photodetector 18.

Figure 3:
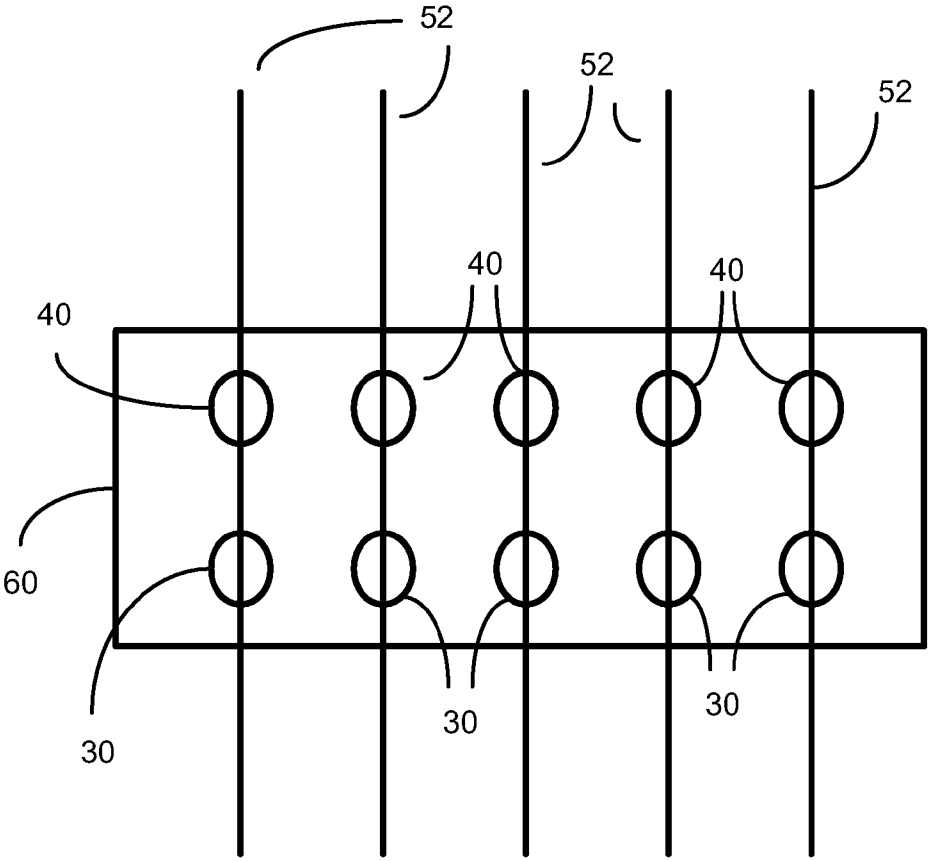
FIG. 3 is a top view of a laser array in one embodiment of the present invention.

FIG. 3 is a top view of a laser array 60 in one embodiment of the present invention. The laser array 60 includes a plurality of laser diodes 30 and photodetectors 40. The laser array is preferably mounted to the surface 38 of the musical stringed instrument 12. In the embodiment depicted in FIG. 3, the musical stringed instrument 12 includes a plurality of strings 52. The laser array, in one embodiment, is a plug-in module attachable to a conventional electric guitar. In another embodiment, the laser array is affixed to the guitar during the manufacture of the guitar.

Figure 4:
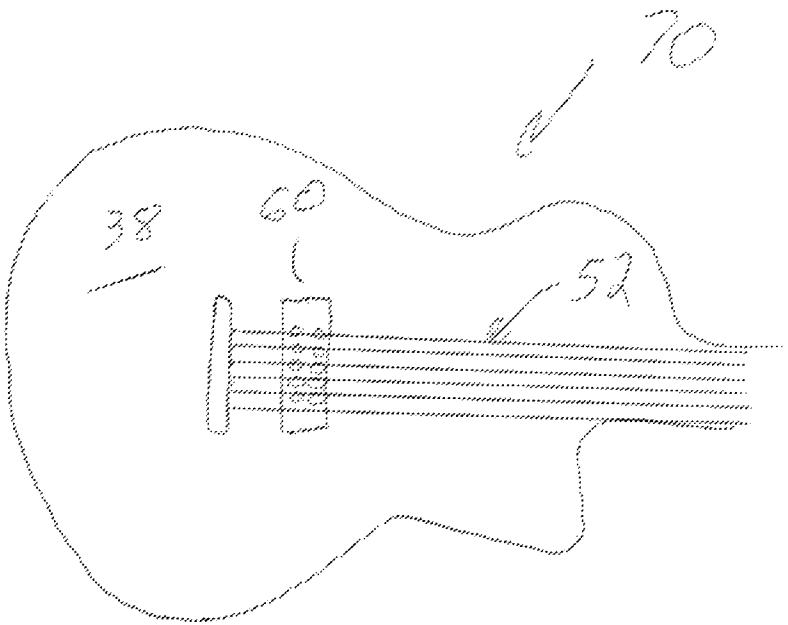
FIG. 4 is a front view of a guitar having the laser array.

FIG. 4 is a front view of a guitar 70 having the laser array 60. The laser array 60 is affixed to the surface 38 of the guitar, adjacent the plurality of strings 52. The guitar is coupled to the amplifier 22 via the connection 20.

In the present invention, the electromagnetic pick-ups utilized in convention electric stringed instruments (e.g., an electric guitar) are replaced by the array 60. The array includes a plurality of the laser diodes 30, one for each string 52. As depicted in FIG. 2, the laser diodes are embedded on the body of the musical instrument in channels 32 located adjacent the surface 38. The laser diodes are set at an angle so that the emitted laser beams 50 exit the laser aperture 36 and then reflect off the underside of the strings 52. A matching plurality of photodetectors 40 is positioned to receive the reflected laser beams 50. As a string vibrates, the string passes in and out of the laser beam, thereby modulating the intensity of the reflected light. This modulation forms the basis of the musical signals produced. The photodetector convert the detected light into electrical signals. These electrical signals are fed to an amplifier which converts the electrical signals into sound. It should be understood that the process of converting the detected light into electrical signals may be conducted by the photodetector or a separate component.

In the preferred embodiment of the present invention, the size of each laser beam is matched to the diameter of its corresponding string. Preferably, the beam has a width less than the diameter of the string. To facilitate the proper sizing of the laser beams, the laser apertures may be sized to narrow the width of the laser beam. Preferably, the apertures are rectangularly shaped and formed in plastic or metal disks. The apertures are located over the diodes, thereby shaping the profile of each beam to match its corresponding string. The apertures may also be utilized to direct the laser beam in a desired direction. Thus, the apertures may be utilized to refine the direction for which the beam is aimed, preferably towards a specific string.

In order to minimize the influence of corrupting signs, the present invention preferably utilizes the optical filters 46. The optical filters are positioned over the photodetectors 40. The optical filters are transparent only for the wavelengths of light generated by the lasers. Other wavelengths, especially those of visible light, are blocked.

In a preferred embodiment of the present invention, an electronic band-pass filter (not shown) affixed to a top of each laser diode 30 may be utilized. These filters only allows audible signals to pass (i.e., those signals created by the laser beams 50). Static signals, produced when the laser light reflects off static (i.e., non-vibrating) strings are undesired.

Figure 5:
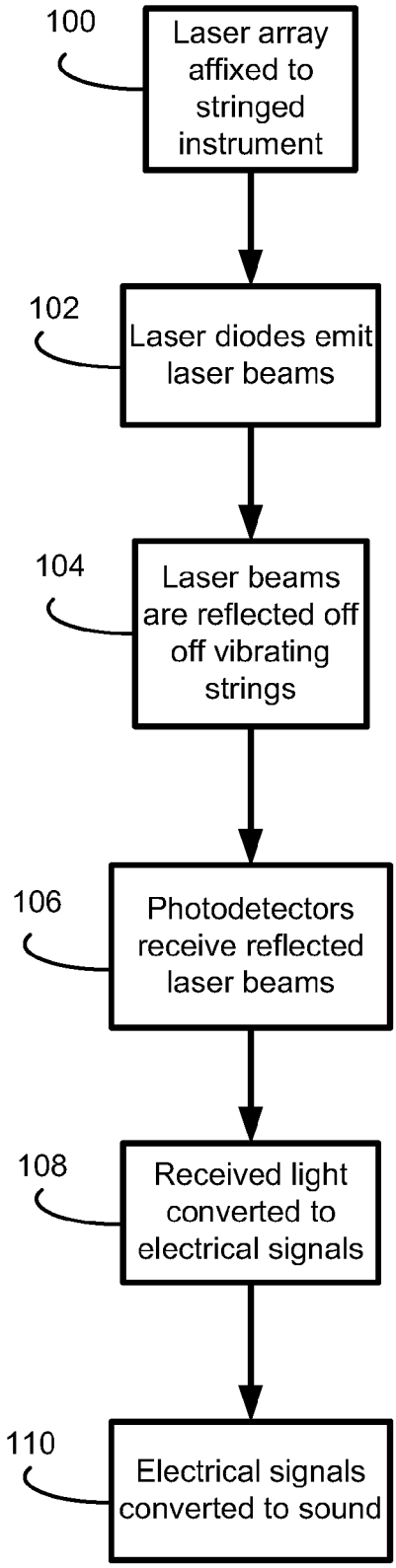
FIG. 5 is a flow chart for generating electrical signals for the musical stringed instrument according to the teachings of the present invention.

FIG. 5 is a flow chart for generating electrical signals for the musical stringed instrument 12 according to the teachings of the present invention. With reference to FIGS. 1-5, the method of the present invention will now be explained. The method begins with step 100 where the laser array 60 is affixed to the surface 38 of the musical stringed instrument 12. Preferably, the laser array is affixed adjacent the plurality of strings 12. The laser array is positioned in such a fashion that the laser beams 50 are able to emanate from the laser diodes and reflect off the vibrating strings and be detected by the photodetectors 40. Next, in step 102, the laser diodes 30 emit laser beams which are shaped by the laser apertures 36. In step 104, the laser beams are reflected off the vibrating strings 52. In step 106, the reflected laser beams 52 are received by the respective photodetectors 40. The optical filters are optionally utilized to prevent inadvertent detection of unwanted light. Next, in step 108, the photodetectors utilize the detected laser beams to generate electric signals. In step 110, the electrical signals are converted by the amplifier 22 into sound.

The present invention may be utilized on any stringed instrument. Any laser generation device may be used which can emit laser light. In addition, any type of laser detection mechanism may be used to detect reflected light. The present invention may be affixed to an existing stringed instrument or incorporated during the manufacture of the musical instrument.

In an alternate embodiment of the present invention, any light source may be utilized which produces a light beam. The present invention is not limited to laser emissions, but may utilize any type of light beam which can reflect off the string. For example, a light-emitting diode may be utilized to provide a light beam to reflect off of the string and be detected by the photodetector.

The present invention provides a unique apparatus and method for sensing vibrating strings. The present invention solves the existing problems associated with distorted noise or humming found in most electrical guitars.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A light pick-up for a musical instrument having a string, the light pick-up comprising:

a light generation mechanism affixed to the musical instrument, the light generation mechanism generating a light beam toward the string, wherein the light generation mechanism is a laser diode generating a laser beam; and a photodetector affixed to the musical instrument adjacent the light generation mechanism for detecting light from the laser beam;

wherein the photodetector having means for converting the detected light into electrical signals, the photodetector being located on a same side of the string as the laser diode relative to the string;

wherein the photodetector and laser diode are positioned in a line substantially parallel to the string; and wherein the photodetector is aligned on a same planar surface as the laser diode;

wherein the light generation mechanism is positioned to allow at least a portion of the laser beam to reflect off the string onto the photodetector;

wherein the photodetector includes an optical filter;

whereby the light generation mechanism is positioned on the musical instrument to direct the laser beam toward the string, the laser beam reflecting off the string and received by the photodetector, the photodetector converting the detected light from the reflected laser beam into electrical signals.

2. The light pick-up according to claim 1, wherein the light pick-up is affixed to an outer surface of the musical instrument.

3. The light pick-up according to claim 1 wherein the laser diode is located within a channel within a body of the musical instrument.

4. The light pick-up according to claim 3 wherein the channel includes a shaped aperture to contour the laser beam emitting from the laser diode, the contoured laser beam being sized and shaped to reflect off the string.

5. The light pick-up according to claim 3 wherein the channel and the laser diode are angled from a surface of the musical instrument.

6. The light pick-up according to claim 5 wherein the laser diode is angled at an approximately thirty degree angle from a vertical axis of the surface of the musical instrument.

7. The light pick-up according to claim 1 wherein the optical filter includes means to filter out unwanted light noise.

8. The light pick-up according to claim 1 wherein the photodetector is located within a channel within a body of the musical instrument.

9. The light pick-up according to claim 8 wherein the photodetector is angled from a surface of the musical instrument.

10. A light pick-up system for use on a musical instrument, the system comprising:

a musical instrument having at least one string, the musical instrument having a body and an outer surface;

at least one light pick-up corresponding to the at least one string, the light pick-up comprising:

a light generation mechanism affixed to the musical instrument, the light generation mechanism generating a light beam, wherein the light generation mechanism is a laser diode generating a laser beam toward the string; and a photodetector affixed to the musical instrument adjacent the light generation mechanism for detecting light from the laser beam;

wherein the photodetector includes means for converting the detected light into electrical signals, the photodetector being located on a same side of the string as the laser diode relative to the string;

wherein the photodetector and laser diode are positioned in a line substantially parallel to the string; and wherein the photodetector is aligned on a same planar surface as the laser diode;

wherein the light generation mechanism is positioned to allow at least a portion of the laser beam to reflect off the string onto the photodetector;

wherein the photodetector includes an optical filter;

whereby the light generation mechanism is positioned on the musical instrument to direct the laser beam toward the string, the laser beam reflecting off the string and received by the photodetector, the photodetector converting the detected light from the reflected laser beam into electrical signals.

11. The light pick-up system according to claim 10 wherein the laser diode is located within a channel within the body of the musical instrument.

12. The light pick-up system according to claim 11 wherein the channel includes a shaped aperture to contour the laser beam emitting from the laser diode, the contoured laser beam being sized and shaped to reflect off the string.

13. The light pick-up system according to claim 11 wherein the channel and the laser diode are angled from the surface of the musical instrument.

14. The light pick-up system according to claim 10 wherein the optical filter includes means to filter out unwanted light noise.

15. The light pick-up system according to claim 10 wherein:

the musical instrument includes a plurality of strings;

the light pick-up includes a plurality of light generation mechanisms and a plurality of corresponding photodetectors, the number of light generation mechanisms and photodetectors corresponding to the number of strings of the musical instrument.

16. A method of utilizing a light pick-up having a light generation mechanism and a photodetector located on a musical instrument having at least one string, the method comprising the steps of:

emitting a laser beam from the light generation mechanism towards the string;

reflecting the laser beam off the string of the musical instrument;

detecting light from the reflected light beam by the photodetector, the photodetector being located on a same side as the light generation mechanism relative to the string;

wherein the photodetector and light generation mechanism are positioned in a line substantially parallel to the string; and wherein the photodetector is aligned on a same planar surface as the light generation mechanism;

converting the detected light into electrical signals;

converting the electrical signals into sound corresponding to vibrations of the string.

* * * * *